United States Patent [19]

Goodwin

[11] Patent Number: 4,673,616

[45] Date of Patent: Jun. 16, 1987

[54] MOLDABLE LATEX IMPREGNATED TEXTILE MATERIAL

[75] Inventor: Robert F. Goodwin, Haverhill, Mass.

[73] Assignee: Foss Manufacturing Co., Inc., Haverhill, Mass.

[21] Appl. No.: 917,807

[22] Filed: Oct. 10, 1986

[51] Int. Cl.[4] ..... B32B 5/06; B32B 27/00

[52] U.S. Cl. ..... 428/289; 264/319; 264/324; 427/389.9; 427/394; 428/290; 428/300; 428/301

[58] Field of Search ..... 428/289, 290, 300, 301; 427/389.9, 394; 264/319, 324

[56] References Cited

U.S. PATENT DOCUMENTS 4,338,369 7/1982 Foënard ..... 428/300

*Primary Examiner*—Marion C. McCamish

*Attorney, Agent, or Firm*—Jerry Cohen

[57] ABSTRACT

A moldable textile material and process for making a textile material partially or wholly impregnated with a variably stiffening polymer rigidifier comprising: a needled non-woven fabric substrate comprising one or more fibers selected from the group consisting of polyesters, polyacrylics, polyester, copolymers, polyacrylic copolymers, wool, cotton, consensation polymers of diamines and dicarboxylic acids, caprolactam based polymers and regenerated cellulose based polymers; and a latex impregnant comprising at least about 25 percent by weight of water, one or more fillers selected from the group consisting of calcium carbonate, clay and zinc oxide, and one or more stiffeners selected from the group consisting of polystyrene, styrene-acrylonitrile, styrene-acrylonitrile-butadiene, styrene acrylates, styrene butadiene, polyvinyl chloride, polyvinyl acetate, alkyl acrylates, polyvinylidene chloride, ethylene vinyl chloride and copolymer and terpolymer of these resins; the fabric substrate being needled in sheet form to a thickness of between about 75 and about 450 mils, the latex being applied to one or both surface(s) of the substrate and penetrating from about 10% to 100% of the thickness thereof.

18 Claims, No Drawings

MOLDABLE LATEX IMPREGNATED TEXTILE MATERIAL

BACKGROUND OF THE INVENTION

This invention relates to modable latex impregnated textile materials and methods for producing the same. Prior moldable products utilize blends of relatively high melting and relatively low melting fibers or two layers of such fabrics needled into each other which are rendered moldable by virtue of bonding between the relatively high and low melting fibers. The problem inherent in producing such prior textile materials is attaining desired ratios of one fiber to the other, needling the two fibers together in such a way as to attain such desired ratio, and needling the two fibers together in such a manner as to achieve the desired ratio in a specific layer or area of the overall fabric.

SUMMARY OF THE INVENTION

It is an object of the invention, therefore, to provide a moldable, homogeneous and/or layered textile material which may comprise a single fiber material or a blend of fibers.

It is a further object of the invention to provide a textile material which is impregnated with a variably stiffening polymer rigidifier.

It is a further object of the invention to provide a textile material impregnated with a latex polymer rigidifier which upon drying allows the overall textile material to be readily molded into a predetermined three-dimensional shape and permanently stiffened into the desired three-dimensional shape by application of heat to the latex impregnated portion of the textile material and then cooling in a mold of the desired three-dimensional shape.

In accordance with the invention there is provided a moldable textile material partially or totally impregnated with a variably stiffening polymer rigidifier comprising a needled non-woven fabric substrate comprising one or more fibers selected from the group consisting of polyesters, polyacrylics, polyester copolymers, polyacrylic copolymers, wool, cotton, condensation polymers of diamines and dicarboxylic acids, caprolactam based polymers and regenerated cellulose based polymers; and a latex impregnant comprising at least about 25 percent by weight of water, one or more fillers selected from the group consisting of calcium carbonate, clay and zinc oxide, and one or more polymer stiffeners selected from the group consisting of polystyrene, styrene acrylates, styrene-acrylonitrile-butadiene, carboxylated styrene-butadiene, styrene-butadiene, polyvinyl chloride, polyvinyl acetate, alkyl acrylates, polyvinylidene chloride, ethylene vinyl chloride and copolymers or terpolymers of these resins; the fabric substrate being needled in sheet form to a width of between about 75 and about 450 mils and the latex being applied to one surface or both surfaces of the substrate and penetrating from 10% to 100% thereof.

The latex impregnant typically comprises between about 25 and about 65 percent by weight of the polymer stiffener and between about 5 and about 50 percent by weight of the filler. The aqueous latex impregnant may also include between about 1 and about 5 percent by weight of a plasticizer.

The latex impregnant coating is dried and stiffened within the matrix of the fabric substrate by application of heat of between about 375 and about 450 degrees Fahrenheit to the latex coated or impregnated portion of the substrate for a period of time preselected to remove the water. The dried impregnated portion of the textile material is typically further subjected to heat of between about 300 and about 400 degrees Fahrenheit for a second predetermined amount of time to re-soften the stiffening polymer rigidifier in the textile material to a relatively soft, flexible form prior to inserting into the three-dimensional molding form.

The needled fabric substrate preferably has a weight of not less than about five ounces per square yard and the latex penetrates not less than about 10 percent of the thickness thereof.

In accordance with the invention there is also provided a method of making a moldable, hardenable, non-woven textile material comprising the steps of: selecting one or more fibers from the group of fibers consisting of polyesters, polyacrylics, polyester, copolymers, polyacrylic, copolymers, wool, cotton, condensation polymers of diamines and dicarboxylic acids, caprolactam based polymers and regenerated cellulose based polymers; needling the fibers into a non-woven web of sheet form having a weight greater than about 5 ounces per square yard and a thickness of between about 75 and about 450 mils; impregnating a surface or surfaces of the needled sheet form web to a depth of between about 10 and about 100 percent of the thickness thereof with a latex impregnant comprising at least about 25 percent by weight of water, one or more fillers selected from the group consisting of calcium carbonate, clay and zinc oxide, and one or more polymer stiffeners selected from the group consisting of polystyrene, styrene acrylates, styrene-acrylonitrile, styrene-acrylonitrile-butadiene, styrene butadiene, carboxylated styrene-butadiene, polyvinyl chloride, polyvinyl acetate, alkyl acrylates, polyvinyl chloride, ethylene vinyl chloride and copolymer or terpolymer of these resins; and, drying the latex impregnant within the matrix of the fabric web by heating the latex impregnated portion of the web to between about 375 and about 450 degrees Fahrenheit for a period of time preselected to remove the water therefrom.

The latex impregnant preferably comprises between about 25 and about 65 percent by weight of the polymer stiffener and between about 5 and about 50 percent by weight of the filler. The aqueous latex impregnant typically further includes between about 1 and about 5 percent by weight of a plasticizer.

The step of impregnating typically comprises coating a surface of the sheet form web with the aqueous latex impregnant and passing the coated web through the nip of a pair of pressure rolls having a gap of between about 20 and about 100 mils. Alternatively, both surfaces of the sheet form web can be coated and passed through the nip rollers.

In accordance with the invention there is further provided a method of molding a textile material into a predetermined three dimensional shape comprising applying the dried, latex impregnated textile material formed by the method described above, heating the dried latex impregnated portion of the fabric web to a temperature of between about 300 and about 400 degrees Fahrenheit for a predetermined amount of time and applying the web to a mold having the predetermined three-dimensional shape. The mold is cooled by air or water to set said shape.

Further in accordance with the invention there is provided a moldable textile material and a molded textile material formed by the methods described above.

DETAILED DESCRIPTION OF PREFERRED EMBODIMENTS

In accordance with the invention either a single fiber material or a blend of fiber materials is preselected for needling into a sheet form of non-woven web. The fibers or fabric materials preferred for use in constructing the textile sheet are any one or a blend of the following fabric materials: polyesters, polyacrylics, polyester copolymers, polyacrylic copolymers, wool, cotton, nylons i.e., condensation polymers of diamines and dicarboxylic acids—typically sebacic acid and/or adipic acid such as nylon-6 or caprolactam—a specific condensation polymer of diamine and dicarboxylic acid, and rayon (man-made textile fibers comprising regenerated cellulose). The selected non-woven fabric material or materials (pre-blended) are needled by conventional needle-punch processes into a sheet typically of between about 75 and about 450 mils thickness and having a weight of preferably not less than about 5 ounces per square yard. After needling the sheet form fabric comprises a web of non-woven fibers which are entangled together. The sheet form web is thus limp after needlng having little or no ability to retain any three-dimensional shape.

Once the sheet form web is formed, it is coated on one or both surface(s) with a liquid aqueous latex dispersion typically by coating, spraying or selective bathing. The latex dispersion preferably comprises water, one or more fillers such as calcium carbonate, clay and/or zinc oxide, and a variable polymer stiffener. The stiffener is preferably a polymer or polymer forming substance such as polystyrene, styrene acrylate, styrene-acrylonitrile, styrene-acrylonitrile-butadiene, styrene butadiene, carboxylated styrene-butadiene, vinyl chloride, polyvinyl chloride, polyvinyl acetate, an alkyl acrylate such as methyl methacrylate, polyvinylidene chloride, ethylene-vinyl chloride, and/or copolymer or terpolymer of these resins. Blends of the foregoing stiffeners may also be employed.

Once the latex is applied to the surface or surfaces of the needled sheet form web, the textile sheet is preferably passed through the nip of a pair of pressure rolls having a gap of between about 20 and about 100 mils and wherein the pressure exerted on the textile sheet is maintained at between about 10 and about 30 pounds per linear inch. Depending upon the amount of latex initially applied to the surface of the sheet form web, between about 10 and about 100 percent of the thickness of the sheet is preferably impregnated with the latex. One surface of the sheet having a depth of from about 25 to about 90 percent of the thickness of the sheet can be left un-impregnated with latex and retains a fabric/textile-like character, if desired. Alternatively both surfaces of the textile sheet may be coated.

The textile sheet thus impregnated with the latex is typically routed, directly out of the nip of the pressure rolls into a drier or heater such as a hot convection oven, infrared applicator, microwave oven or the like, and the latex impregnated portion of the sheet is subjected to a temperature sufficient to remove the water component of the latex impregnant.

In the preferred product and process where water comprises at least about 25 percent by weight of the latex, the latex impregnated portion of the impregnated sheet is preferably subjected to a temperature of between about 375 and about 450 degrees Fahrenheit for a predetermined amount of time sufficient to remove the water. Typically the wet, latex impregnated sheet is fed at a rate of between about 5 and about 30 yards per minute through the 375°–450° F. oven or heater. In the usual case a given spot of the wet latex impregnated sheet is subject to the 375°–450° heat for less than about 180 seconds.

Most preferably, the aqueous latex impregnant includes a plasticizer, e.g., an ester such as dioctylphthalate to aid the stiffener/polymer in forming a coalesced polymer matrix within the web of the fabric upon removal of the water.

In a most preferred embodiment of the invention, water comprises at least about 25 percent by weight of the latex, the filler(s) comprise between about 5 percent and about 50 percent by weight of the latex, the stiffener comprises between about 25 percent and about 60 percent by weight of the latex and the plasticizer comprises from about 1 percent to about 5 percent by weight of the latex.

After the latex impregnated web has been dried, the polymer stiffener, originally dispersed as particles within the water, coalesces into a semi-coagulated mass of polymer within the matrix of the fabric web. It can be limited in penetration by virtue of a one-sided application process to one surface of the sheet product and penetrating a depth of less than about 75 percent of the original thickness of the untreated fabric. Alternatively, the web can also be 100% impregnated via a two-sided application. After drying, the semi-coagulated stiffener, remaining within the web, imparts a semi-stiff, non-limp, resilient character to the dried sheet. Although the dried product is semi-stiff, it remains bendable or formable into essentially any desired contour by application of relatively light pressure to the sheet.

The dried sheet having the semi-coagulated stiffener therein may be rendered considerably stiffer by applying heat at a temperature of about 300°–400° F. to the semi-stiffened, dried latex impregnated portion of the fabric web to temporarily soften the stiffener. The softened material is then applied to a mold having the desired three dimensional shape. Preferably such preheating is carried out for about 30 to about 180 seconds, the specific length of time varying inversely with the specific softening temperature selected.

Most preferably the pre-softened sheet product is applied under pessure to a mold having a predetermined contour thereby forcing the softened sheet to assume the predetermined three-dimensional contour of the mold. The mold is preferably water cooled so as to most efficiently cool the softened fabric; the fabric residing in the mold may otherwise be air cooled after it has been pre-heated and made to conform to the shape of the mold. Alternatively, the semi-stiffened sheet which is impregnated with the semi-coagulated polymer stiffener can be simultaneously softened and molded by applying the sheet to a mold heated to about 300°–400° F. to simultaneously soften and compress the material into the desired three dimensional shape; the stiff sheet and the surface of the mold are typically maintained in pressure contact for less than about 2 minutes and most preferably for about 30 to about 90 seconds, the specific length of time varying inversely with the temperature of the mold.

The polymer stiffener residing in the matrix of the fabric web is thus fused after the 300°–400° softening step and subsequent cooling in the mold into a relatively hard, stiff and polymerized matrix. Upon emergence from the molding process, the resultant textile/polymer product maintains the three-dimensional contour of the mold essentially indefinitely and further retains a substantial resiliency when subjected to bending or other deformation out of the predetermined molded contour.

After the fabric has been pre-heated and applied to the mold, it is preferably cooled while still residing in the mold. Typically the cooling process is performed with the fabric remaining and residing in the mold until the fabric has cooled, typically from about 15 seconds to about 180 seconds depending on the method of cooling, e.g. by air or by water cooling.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A moldable textile material partially impregnated with a variably stiffening polymer rigidifier comprising:

a needled non-woven fabric substrate comprising one or more fibers selected from the group consisting of polyesters, polyacrylics, polyester, copolymers, polyacrylic copolymers, wool, cotton, consensation polymers of diamines and dicarboxylic acids, caprolactam based polymers and regenerated cellulose based polymers; and a latex impregnant comprising at least about 25 percent by weight of water, one or more fillers selected from the group consisting of calcium carbonate, clay and zinc oxide, and one or more stiffeners selected from the group consisting of polystyrene, styrene acrylates, styrene-acrylonitrile, styrene-acrylonitrile-butadiene, styrene butadiene, carboxylated styrene-butadiene, polyvinyl chloride, polyvinyl acetate, alkyl acrylates, polyvinylidene chloride, ethylene vinyl chloride and copolymer and terpolymer of the foregoing resins, the fabric substrate being needled in sheet form to a thickness of between about 75 and about 450 mils and said latex penetrating at least 10% of the thickness of the substrate.

2. The textile material of claim 1 wherein the latex impregnant comprises between about 25 and about 65 percent by weight of the polymer stiffener and between about 5 and about 50 percent by weight of the filler.

3. The textile material of claim 2 wherein the aqueous latex impregnant further comprises between about 1 and about 5 percent by weight of a plasticizer.

4. The textile material of claim 3 wherein the latex impregnant is dried and stiffened within the matrix of the fabric substrate by application of heat of betweeb about 375 and about 450 degrees Fahrenheit to the latex impregnated portion of the substrate for a period of time preselected to remove the water.

5. The textile material of claim 4 wherein the dried impregnated portion of the textile material is further subjected to heat of between about 300 and about 400 degrees Fahrenheit for a second period of time less than about 180 seconds.

6. The textile material of claim 4 wherein the needled fabric substrate has a weight of not less than about five ounces per square yard.

7. The textile material of claim 1 wherein the latex impregnant is dried and stiffened within the matrix of the fabric substrate by application of heat of between about 375 and about 450 degrees Fahrenheit to the latex impregnated portion of the substrate for a period of time preselected to remove the water.

8. The textile material of claim 7 wherein the dried impregnated portion of the textile material is further subjected to heat of between about 300 and about 400 degrees Fahrenheit for a second period of time less than about 180 seconds.

9. The textile material of claim 7 wherein the needled fabric substrate has a weight of not less than about five ounces per square yard.

10. Method of making a moldable, hardenable, non-woven textile material comprising the steps of:

selecting one or more fibers from the group of fibers consisting of polyesters, polyacrylics, polyester, copolymers, polyacrylics, copolymers, wool, cotton, condensation polymers of diamines and dicarboxylic acids, caprolactam based polymers and regenerated cellulose based polymers;

needling the fibers into a non-woven web of sheet form having a weight greater than about 5 ounces per square yard and a thickness of between about 75 and about 450 mils;

impregnating a surface of the needled sheet form web to a depth of at least about 10 percent of the thickness thereof with a latex impregnant comprising at least about 25 percent by weight of water, one or more fillers selected from the group consisting of calcium carbonate, clay and zinc oxide, and one or more stiffeners selected from the group consisting of polystyrene, styrene-acrylonitrile, styrene-acrylonitrile-butadiene, styrene acrylates, styrene butadiene, carboxylated styrene-butadiene, polyvinyl chloride, polyvinyl acetate, alkyl acrylates, polyvinylidene chloride, ethylene vinyl chloride, and copolymer and terpolymer of the foregoing resins; and, drying the latex impregnant within the matrix of the fabric web by heating the latex impregnated portion of the web to between about 375 and about 450 degrees Fahrenheit for a period of time preselected to remove the water therefrom.

11. The method of claim 10 wherein the latex impregnant comprises between about 25 and about 65 percent by weight of the polymer stiffener and between about 5 and about 50 percent by weight of the filler.

12. The method of claim 11 wherein the aqueous latex impregnant further comprises between about 1 and about 5 percent by weight of a plasticizer.

13. The method of claim 12 wherein the step of impregnating comprises coating a surface of the sheet form web with the aqueous latex impregnant and passing the coated web through the nip of a pair of pressure rolls having a gap of between about 20 and about 100 mils.

14. A method of molding a textile material into a predetermined three dimensional shape comprising preheating the dried latex impregnated portion of the fabric web formed by the method of claim 13 to a temperature of between about 300 and about 400 degrees Fahrenheit for a period of time less than about 180 seconds and applying the pre-heated material to a mold having the predetermined three-dimensional shape.

15. The method of claim 10 wherein the step of impregnating comprises coating a surface of the sheet form web with the aqueous latex impregnant and passing the coated web through the nip of a pair of pressure rolls having a gap of between about 20 and about 100 mils.

16. A method of molding a textile material into a predetermined three dimensional shape comprising preheating the dried latex impregnated portion of the fabric web formed by the method of claim 15 to a temperature of between about 300 and about 400 degrees Fahrenheit for a period of time less than about 180 seconds and applying the pre-heated material to a mold having the predetermined three-dimensional shape..

17. A method of molding a textile material into a predetermined three dimensional shape comprising preheating the dried latex impregnated portion of the fabric web formed by the method of claim 10 to a temperature of between about 300 and about 400 degrees Fahrenheit for a period of time less than about 180 seconds and applying the pre-heated material to a mold having the predetermined three-dimensional shape.

18. The product of the methods of claims 10, 12, 15, 13, 17, 16 or 14.

* * * * *